US007464530B2

(12) United States Patent
Stahlecker et al.

(10) Patent No.: US 7,464,530 B2
(45) Date of Patent: Dec. 16, 2008

(54) PROCESS FOR PREPARING A PIECING OPERATION IN AN AIR JET SPINNING ARRANGEMENT

(75) Inventors: Gerd Stahlecker, Eislingen (DE); Gernot Schaeffler, Waeschenbeuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 11/665,354

(22) PCT Filed: Oct. 13, 2005

(86) PCT No.: PCT/EP2005/010995

§ 371 (c)(1),
(2), (4) Date: Apr. 13, 2007

(87) PCT Pub. No.: WO2006/042686

PCT Pub. Date: Apr. 27, 2006

(65) Prior Publication Data

US 2008/0066442 A1 Mar. 20, 2008

(30) Foreign Application Priority Data

Oct. 15, 2004 (DE) ..... 10 2004 050 968

(51) Int. Cl.
*D01H 4/48* (2006.01)

(52) U.S. Cl. ..... 57/263

(58) Field of Classification Search ..... 57/263
See application file for complete search history.

(56) References Cited

U.S. PATENT DOCUMENTS 5,809,764 A 9/1998 Baba
6,679,043 B2 1/2004 Griesshammer et al.
6,691,601 B2 2/2004 Anderegg et al.
6,959,532 B2 * 11/2005 Wust et al. ..... 57/22

FOREIGN PATENT DOCUMENTS

EP 1 205 588 B1 5/2002
EP 1 219 737 B1 7/2002

OTHER PUBLICATIONS

International Search Report dated Jan. 19, 2006 with an English translation of the pertinent portions (Five (5) pages).
Form PCT/ISA/237 dated Jan. 2004 with an English translation of the pertinent portions (Seven (7) pages).

* cited by examiner

*Primary Examiner*—Shaun R Hurley
(74) *Attorney, Agent, or Firm*—Crowell & Moring LLP

(57) ABSTRACT

A process for preparing a piecing operation in an air jet spinning arrangement is described. The air jet spinning arrangement comprises a drafting device, whose main drafting zone is bordered on its entry side by an apron roller pair and on its exit side by a delivery roller pair. The apron roller pair is connected to a first drive, the delivery roller pair to a second drive. When the spinning process is interrupted, the delivery of a closed staple fiber strand is stopped in the main drafting zone and a new starting end of the staple fiber strand is created. This new starting end is to be pieced together with an end of a thread already spun. To create a new starting end of the staple fiber strand suitable for piecing, the apron roller pair and the delivery roller pair are each controlled separately when the spinning process is interrupted and are shut down one after the other, in such a way that in the main drafting zone a new starting end of the staple fiber strand is formed.

10 Claims, 6 Drawing Sheets

PROCESS FOR PREPARING A PIECING OPERATION IN AN AIR JET SPINNING ARRANGEMENT

BACKGROUND AND SUMMARY OF THE INVENTION

The present invention relates to a process for preparing a piecing operation in an air jet spinning arrangement, which comprises a drafting device, whose main drafting zone is bordered on its entry side by an apron roller pair connected to a first drive and on its exit side by a delivery roller pair connected to a second drive, whereby when the spinning process is interrupted the delivery of a closed staple fibre strand is stopped in the main drafting zone and a new starting end of the staple fibre strand, which is to be pieced with a thread already spun, is created, in that the apron roller pair is shut down while the delivery roller pair continues to run.

A process of this type is described in U.S. Pat. No. 5,809,764. This publication discloses, amongst others, a variation in which the apron roller pair is immediately shut down subsequent to an end break while the delivery roller pair continues to run, so that a staple fibre strand can no longer be fed to the delivery roller pair. The delivery of a closed staple fibre strand in the main drafting zone is thus inevitably stopped. As the point of separation of the staple fibre strand is deemed as unsuitable for a piecing operation according to the known publication, it is provided additionally for the preparation of a piecing operation that after the apron roller pair is stopped, but while the delivery roller pair is still running, a new starting end of the staple fibre strand is created. This occurs in that the apron roller pair starts up briefly and is then stopped again. Thus a break point is again created in the main drafting zone in the staple fibre strand, which is now considered suitable for the piecing operation. Only subsequent thereto does the actual piecing operation begin with the starting-up of the apron rollers and the rollers of the drafting device arranged upstream thereto. It is evident that because of the starting-up again of the apron roller pair and its being stopped again, that the cycle length of the piecing operation is extended. Attention is also drawn to the fact that a delicate handling of the staple fibre strand is not possible, as the delivery roller pair, as mentioned above, runs continuously at operating speed while the drive of the apron roller pair can only be switched on or off.

It is an object of the present invention to optimize the process of the above mentioned type with regard to the cycle time and the quality of the new starting end of the staple fibre strand as preparation for a piecing operation in an air jet spinning arrangement.

This object has been achieved in accordance with the present invention such that during an interruption in the spinning process, the apron roller pair and the delivery roller pair are controlled separately and are stopped one after the other in such a way that, in the main drafting zone a new starting end of the staple fibre strand is on hand and is suitable for piecing.

In the process according to the present invention, a new starting end of the staple fibre strand suitable for piecing is already created at the first stopping of the apron roller pair. A repeated starting-up and stopping of the apron roller pair is not necessary, thus reducing the length of the cycle. Because both the apron roller pair and the delivery roller pair are stopped in a controlled way, although at different times, a better quality separation point of the staple fibre strand, that is, the new starting end of the staple fibre strand, can be directly created. Both the apron roller pair and the delivery roller pair are ultimately stopped, namely in such a way that a required amount of fibres necessary for the spinning process are held nipped by the apron roller pair. As the delivery roller pair also comes to a standstill, it can be opened, which facilitates the preparation work for the piecing operation. It is a prerequisite of the present invention that individually controlled drives are provided separately for both the apron roller pair and the delivery roller pair.

In an embodiment of the present invention, it is provided that the new starting end of the staple fibre strand suitable for piecing is pulled very slightly backwards in the opposite direction to its operational rotational direction in which the apron roller pair is temporarily driven. After the separation point suitable for piecing is created, the starting end of the staple fibre strand is withdrawn to such a degree that it is just barely visible. The starting end of the staple fibre strand suitable for piecing is protected, for example against airstreams, which are necessary in practice for the feeding back of a thread end to which the staple fibre strand is to be pieced. The subsequent starting-up also takes place in a controlled way. Only after a defined starting-up time are the normal drafting speeds, that is the constant operational speeds for the apron roller pair and the delivery roller pair achieved.

In an embodiment of the present invention it is further provided that the delivery roller pair is opened shortly before it finally comes to standstill. This prevents the starting end of the staple fibre strand suitable for a piecing operation from being adversely effected, as long as the delivery roller pair is still running. Damage would occur if the delivery roller, while running down, were to turn backwards by several angular minutes directly before it came to a complete standstill, which is often the case when the drive uses a drive belt which is under tension, and this tension lessens when the drive force is discontinued. Before this can occur, the delivery roller pair is opened in order to protect the separation point of the staple fibre strand, the delivery roller pair only then being brought to a standstill.

Because of the process according to the present invention, a better quality new starting end of the staple fibre strand is generated, which quality remains after the apron roller pair and the delivery roller pair are shut down.

BRIEF DESCRIPTION OF THE DRAWINGS

These and further objects, features and advantages of the present invention will become more readily apparent from the following detailed description thereof when taken in conjunction with the accompanying drawings, wherein.

DETAILED DESCRIPTION OF THE DRAWINGS

Figure 1:
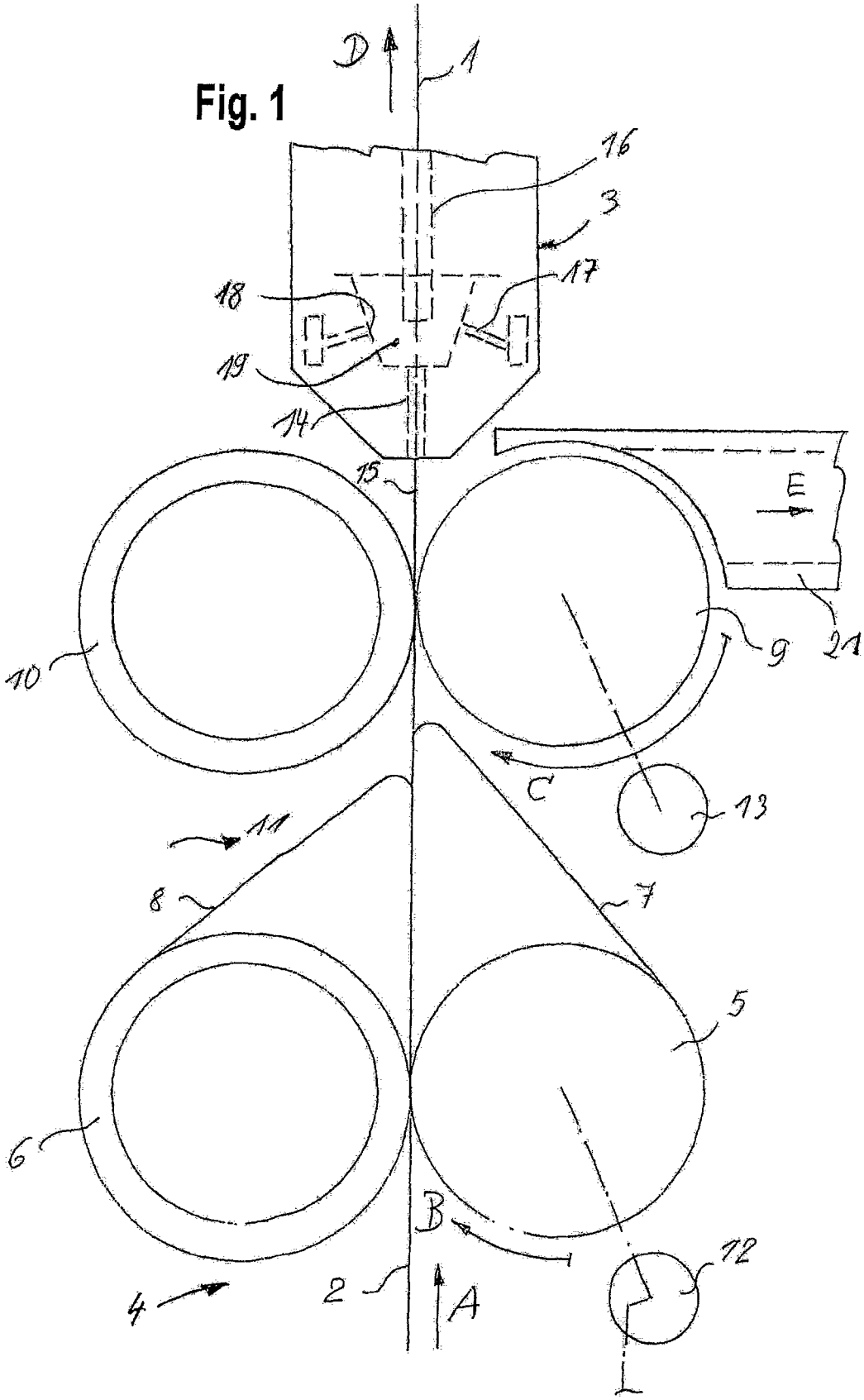
FIG. 1 shows the area of a drafting device of an air jet spinning arrangement during normal spinning operation.

The air jet spinning arrangement shown in FIG. 1, which shows the operation state, serves to spin a thread 1 from a staple fibre strand 2. The spinning arrangement includes an airjet assembly 3 as an essential component part, which, for example, can be designed according to the above mentioned prior art, also including a drafting unit 4 preferably designed as a three-cylinder drafting unit, also including a withdrawal roller pair and a winding device (not shown).

The partially shown drafting device 4 has an entry roller pair (not shown), further an additional apron roller pair 5, 6 which is looped conventionally by guiding aprons 7 and 8, as well as a delivery roller pair 9, 10 at which the main drafting zone 11 of the drafting device 4 ends.

The staple fibre strand 2 is drafted in the drafting device 4 in drafting direction A to the desired degree of fineness, as is known in the art.

Each roller pair of the drafting device 4 includes a driven bottom roller and a spring-loaded top roller. For the drive of the apron roller pair 5, 6 as well as for the entry roller pair (not shown), a first drive in the form of a joint drive motor 12 is provided, and for the delivery roller pair 9, 10 a second drive is provided in the form of a drive motor 13. The respective operational rotational directions are denoted by B and C.

The airjet assembly 3 includes a feed channel 14 to which the drafted but still twist-free staple fibre strand in the form of a thin fibre sliver 15 is fed, for receiving its spinning twist. The air jet assembly 3 also includes a thread withdrawal channel 16 for the spun thread 1. In the inside of the air jet assembly 3, air jet nozzles 17 are arranged, whose exit openings 18 lead into a vortex chamber 19, in which the actual twisting process takes place, as described for example in the above mentioned U.S. published Pat. No. 5,809,764. The withdrawal direction of the thread 1 is denoted by the letter D.

For a variety of reasons, for example an end break, the normal spinning process can be interrupted. In this case, the spinning process must be begun again by using a piecing process.

The preparations for such a piecing process are described as follows:

In the case of an end break, to prevent further staple fibre strand 2 from being fed to the drafting device 4, which could lead to clogging, it is provided that the drive motors 12 and 13 are shut down under the control of a yarn break detector (not shown) in a way to be described below. The compressed air feed to the compressed air nozzles 17 is also shut-off. The timing of the shutdown is controlled in such a way that the staple fibre strand 2 does not tear between the entry roller pair (not shown) and the apron roller pair 5,6, but rather remains threaded into the respective nipping lines. In the main drafting zone 11, between the guiding aprons 7, 8 and the delivery roller pair 9, 10, however, the staple fibre strand 2 is cut through by the control system in a way described below. The point of separation with the new starting end of the staple fibre strand 2 is denoted in FIG. 3 by the reference number 20. This point of separation has the form of a fibre tuft.

A suction tube 21 for the purposes of the process according to the present invention, is arranged to the driven delivery roller 9, which suction tube 21 is suctioned according to the suction direction E. The suction tube 21 serves during normal spinning operation to keep the driven delivery roller 9 constantly free of fibre fly.

The drawn length of the arrows B and C shown is not to be understood as a scale, but rather shows whether a roller rotates rapidly or slowly.

After an end break occurs, the fibre flow between the staple fibre strand 2 and the thread 1 is interrupted. Both must be joined together again in a piecing process, and in a way which results in the best quality. For this reason, the delivery of a closed staple fibre strand 2 is stopped after an interruption in the spinning process, and a new starting end 20 of the staple fibre strand 2 is generated, which new starting end 20 is pieced to an end of an already spun thread.

Figure 2:
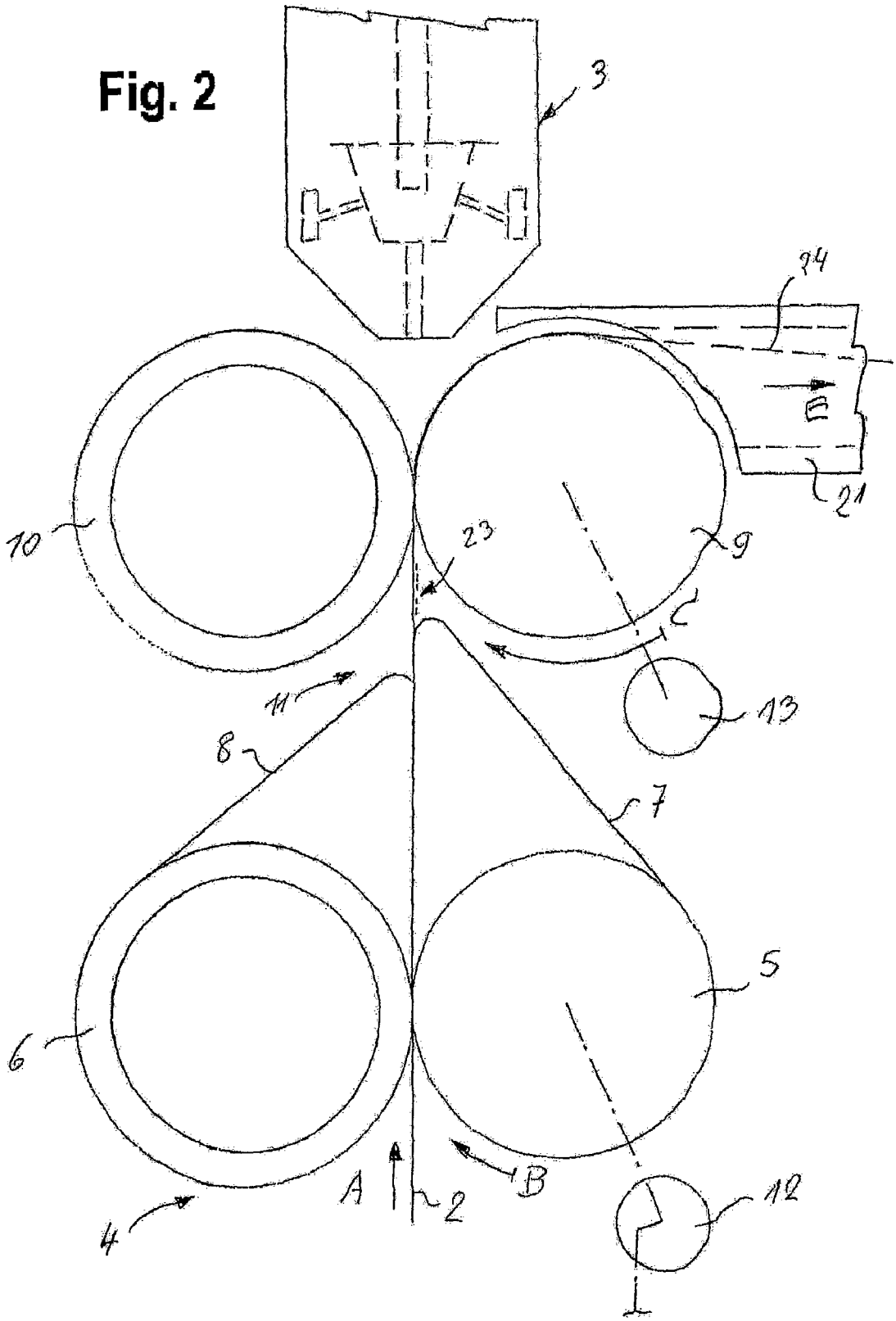
FIGS. 2 to 5 show the individual phases of the process, according to the present invention, for preparing a piecing operation.

FIG. 2 shows the situation after an end break and shows how the first step in the preparation of a piecing process is begun. After an interruption of the spinning process, the apron roller pair 5, 6 and the delivery roller pair 9, 10 are brought in a controlled way, but one after the other, to a standstill by regulating the drive motors 12 and 13. The reduced speed of the driven rollers 5 and 9 can be seen in the rotational direction arrows B and C in FIG. 2, arrows B and C are shorter than those in FIG. 1. The drive motor 13 runs hereby somewhat longer than the drive motor 12. The aim of creating a new starting end 20 (see also FIG. 3) in the area 23 of the main drafting zone 11 can hereby be achieved. The piece 24 of the staple fibre strand 2 to be removed is drawn into the suction tube 21.

Figure 3:
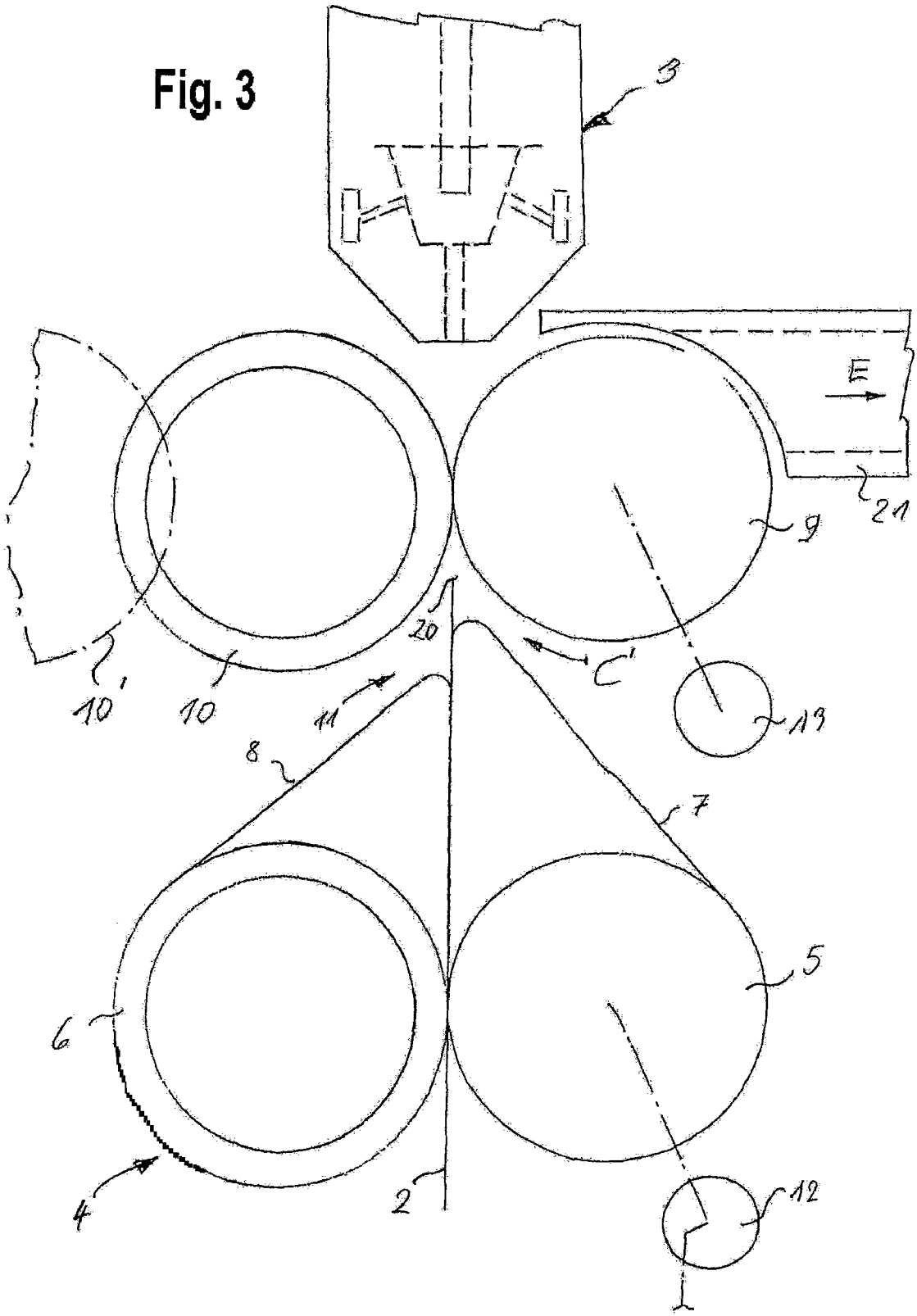

FIG. 3 shows the last phase of the shutting down of the apron roller pair 5, 6 and the delivery roller pair 9, 10, whereby, as already mentioned, the delivery roller pair 9, 10 runs somewhat longer than the apron roller pair 5, 6. In the embodiment in FIG. 3, the drive motor 12 is already shut down, while the drive motor 13 (see the very short arrow C) runs down slowly.

By using the controlled shut-down of the apron roller pair 5, 6 and the delivery roller pair 9, 10, a good quality new starting end 20 of the staple fibre strand 2 having a fibre tuft suitable for piecing can be achieved on the first shut-down. Directly before the drive motor 13 is shut down finally, the delivery roller pair 9, 10 is already opened, so that the spring-loaded top roller 10 achieves the position 10' denoted by the dot-dash line. This prevents, in a way described above, the starting end 20 of the staple fibre strand 2 being in any way impaired when the delivery roller 9 of the delivery roller pair 9, 10, jerks backwards by several angular minutes at the moment of the shut-down.

Figure 4:
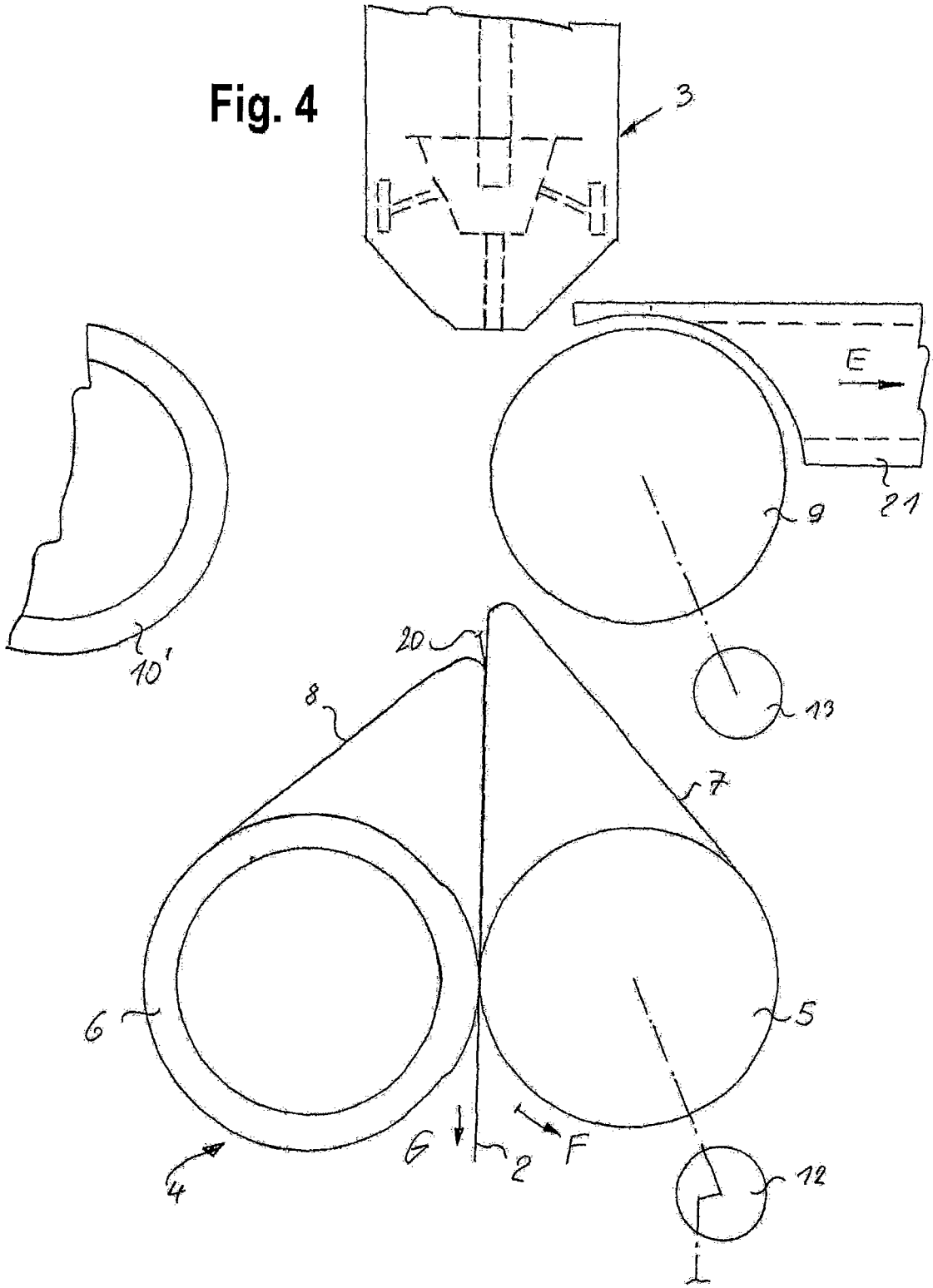

According to FIG. 4, the delivery roller pair 9, 10, whose top roller is now located in position 10', is also at a complete standstill. The apron roller pair 5,6 is now driven a very small distance backwards via the drive motor 12, as shown by rotational direction arrow F, whereby the staple fibre strand 2 and thus the new starting end 20 of the staple fibre strand 2 is slightly pulled back according to arrow direction G. Directly subsequent to this, the apron roller pair 5, 6 is brought to a complete standstill. Thus, the new starting end 20 of the staple fibre strand 2 is protected against outside influences, for example, disruptive air streams.

Figure 5:
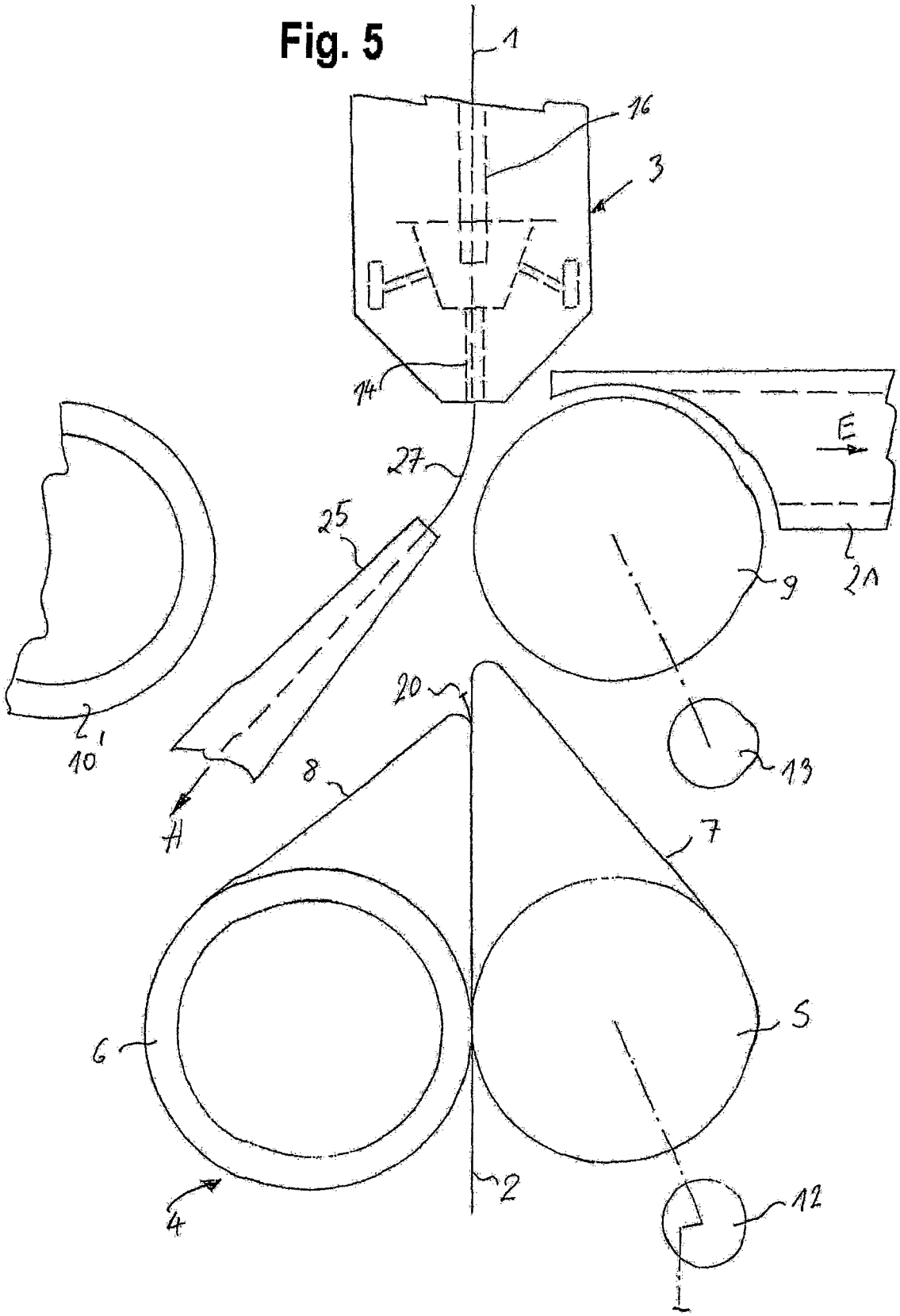
Figure 6:
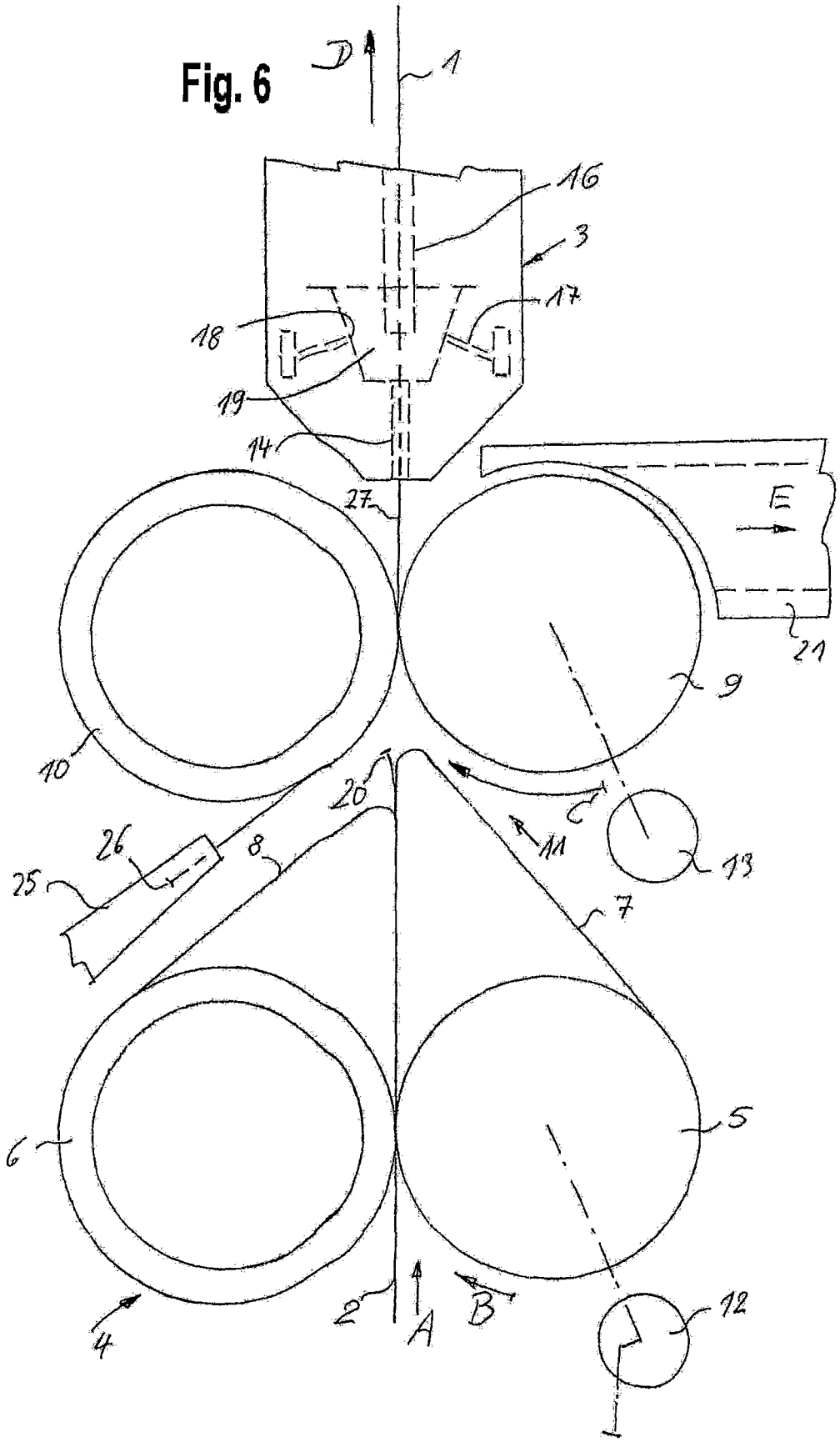
FIG. 6 shows the starting of the drafting device for carrying out the actual piecing process.

According to FIG. 5, a piecing thread 27, which is part of an already spun thread 1, can now be seized at the winding device (not shown) and fed backwards through the air jet assembly 3 to the area of the drafting device 4. This backwards feeding takes place in the direction opposite to that of the normal withdrawal direction D. This can occur with the support of an injection air stream (not shown). It is for this reason that the starting end 20 of the staple fibre strand 2 is protected as much as possible. The piecing thread 27 can be taken up by a suction device 25 (suction direction H) of a maintenance device (not shown). At this point in time, the drafting device 4 is entirely at a standstill.

In order to piece the end 26 of the piecing thread 24 located in the suction device 25 to the starting end 20 of the staple fibre strand 2, the re-closed delivery roller pair 9, 10 and the withdrawal roller pair (not shown) and the winding device (not shown) are, in a first phase, started up at initially a reduced speed. In this phase the end 26 of the piecing thread 27 is pulled out of the suction tube 25. A sensor (not shown) establishes when the end 26 of the piecing thread 27 has left the suction tube 25. This is the timing signal for the drive motor 12, by which the starting end 20 of the staple fibre strand 2 is fed to the delivery roller pair 9, 10 at a correctly timed interval. The starting end 20 of the staple fibre strand 2 and the end 26 of the piecing thread 27 can join together in the area of the delivery roller pair 9, 10 and respectively the air jet aggregate 3. For this purpose the compressed air necessary for imparting the spinning twist is also switched on.

To achieve a good piecing process, not only a good quality new starting end 20 of the staple fibre strand 2 must be created, but also a good quality end 26 of the piecing thread 27. The end 26 is therefore advantageously formed as a thread brush (not shown).

As soon as the new starting end of the staple fibre strand 2 is joined to the end 26 of the piecing thread 27, the drive motors 12 and 13 are started up in a controlled way to their normal operational speeds, after which the operational state is reached as shown in FIG. 1 and described above.

The invention claimed is:

1. A process for preparing a piecing operation in an air jet spinning arrangement comprising a drafting device, having a main drafting zone bordered on its entry side by an apron roller pair connected to a first drive and on its exit side by a delivery roller pair connected to a second drive, the process comprising the acts of:

stopping the delivery of a staple fibre strand in the main drafting zone when the spinning process is interrupted; and creating a new starting end of the staple fibre strand, to be pieced with a thread already spun, the new starting end being formed by:

shutting down the apron roller pair while the delivery roller pair continues to run and separately controlling the apron roller pair as well as the delivery roller pair, initially bringing the apron roller pair to a standstill and then bringing the delivery roller pair to a standstill, such that the new starting end of the staple fibre strand suitable for piecing is present in the main drafting zone after stopping of the apron roller pair and the delivery roller pair.

2. The process according to claim 1, further comprising pulling back slightly the new starting end of the staple fibre strand suitable for piecing by temporarily driving the apron roller pair in an opposite direction to its operational rotational direction.

3. The process according to claim 1, further comprising opening the delivery roller pair shortly before it comes to a complete standstill.

4. A method of piecing a fibre strand fed to an air jet assembly to form a thread, comprising the acts of:

slowing to a stop a pair of apron rollers following a break of the fibre strand;

slowing to a stop a pair of delivery rollers, after the apron rollers, thereby defining a starting end of the fibre strand;

opening the pair of delivery rollers after stopping thereof;

driving the pair of apron rollers backwards a small distance to pull back the starting end of the fibre strand;

feeding backwards from the air jet assembly a piecing portion of the thread therein;

starting at slow speed the pair of delivery rollers to move the piecing portion of the thread to a selected position; and starting the pair of apron rollers when the piecing portion reaches the selected position to piece together the piecing portion of the thread and the starting end of the fibre strand.

5. The method according to claim 4, further comprising the acts of activating a suction device to feed backwards the piecing portion of the thread.

6. The method according to claim 4, further comprising the acts of providing compressed air to assist joining the piecing portion of the thread and the starting end of the fibre strand.

7. The method according to claim 4, further comprising accelerating to a normal operating speed the pairs of delivery rollers and apron rollers after joining of the piecing portion of the thread and the starting end of the fibre strand.

8. An air jet spinning device, comprising:

an air jet assembly having a vortex chamber spinning a fibre strand therein into a thread;

a drafting unit feeding the fibre strand to the air jet assembly;

delivery rollers handling the fibre strand; and apron rollers feeding the fibre strand to the delivery rollers, a speed of the apron rollers being separately controllable from that of the delivery rollers;

wherein, after a break of the thread, the delivery rollers are slowed and stopped after first slowing and stopping the apron rollers, thus placing a starting end of the fiber strand in a main drafting zone when the drive and apron rollers are stopped, and a piecing portion of the thread is moved backwards to piece with a starting end of the fibre strand, before restarting the delivery rollers and then the apron rollers.

9. The air jet spinning device according to claim 8, further comprising a suction tube to move the piecing portion backwards.

10. The air jet spinning device according to claim 8, wherein the delivery rollers are openable after the break of the thread.

* * * * *